US006763735B2

(12) United States Patent
Siems et al.

(10) Patent No.: US 6,763,735 B2
(45) Date of Patent: Jul. 20, 2004

(54) STARTER DEVICE

(75) Inventors: Hans-Dieter Siems, Eberdingen (DE); Ngoc-Thach Nguyen, Grossbottwar (DE); Sven Hartmann, Stuttgart (DE); Hans Braun, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 157 days.

(21) Appl. No.: 09/980,935

(22) PCT Filed: Mar. 8, 2001

(86) PCT No.: PCT/DE01/00868

§ 371 (c)(1),
(2), (4) Date: Mar. 4, 2002

(87) PCT Pub. No.: WO01/77522

PCT Pub. Date: Oct. 18, 2001

(65) Prior Publication Data

US 2003/0097891 A1 May 29, 2003

(30) Foreign Application Priority Data

Apr. 5, 2000 (DE) ..... 100 16 706

(51) Int. Cl.[7] ..... F02N 15/06; F16D 15/06

(52) U.S. Cl. ..... 74/6; 74/7 E; 74/7 R; 123/179.25

(58) Field of Search ..... 74/7 R, 7 E, 6; 123/179.25, 179.26; 290/38 R, 38 A, 28; 310/114, 115, 116, 118, 75 R, 76, 77, 78

(56) References Cited

U.S. PATENT DOCUMENTS

| | | | | |
|---|---|---|---|---|
| 3,741,021 A | | 6/1973 | Parsons | |
| 4,326,429 A | * | 4/1982 | Mortensen | 74/7 R |
| 4,327,300 A | * | 4/1982 | Hoven | 310/75 C |
| 4,346,615 A | * | 8/1982 | Yoneda et al. | 74/7 A |
| 4,460,838 A | * | 7/1984 | Ulicny | 310/76 |
| 4,506,162 A | * | 3/1985 | Bolenz et al. | 290/38 A |
| 4,922,868 A | * | 5/1990 | Ohkanda | 123/179.24 |
| 5,255,644 A | * | 10/1993 | Mills et al. | 123/179.31 |
| 5,291,861 A | * | 3/1994 | Bartlett | 123/179.31 |
| 5,596,902 A | * | 1/1997 | McMillen | 74/7 C |
| 5,617,758 A | | 4/1997 | Nishida | |
| 5,760,485 A | | 6/1998 | Ohmi | |

FOREIGN PATENT DOCUMENTS

DE 24 39 981 A 3/1976

* cited by examiner

*Primary Examiner*—David A. Bucci
*Assistant Examiner*—Colby Hansen
(74) *Attorney, Agent, or Firm*—Michael J. Striker

(57) ABSTRACT

A starter device for starting internal combustion engines having a starter motor (20) that comprises a stator (22) and a rotor (23) as well as a drive shaft (58) as starter components (21), further having a driven element (70) that can actively be connected to the drive shaft (58) and the internal combustion engine, and having a brake device (100) that acts on the driven element (70) is proposed. The starter device is characterized in that the brake device (100) can be actuated by means of at least one starter component (21) by switching on the starter motor (20).

15 Claims, 11 Drawing Sheets

STARTER DEVICE

BACKGROUND OF THE INVENTION

The invention relates to a starter device for starting internal combustion engines.

Bendix starters are made known in the prior art. These Bendix starters comprise an electric starter motor with an armature shaft having a helically-grooved thread on one end. A tang shank is situated on this helically-grooved thread in rotatable and displaceable fashion; it is connected to a starting pinion via an overrunning clutch. The tang shaft moves into mesh with the overrunning clutch and the starting pinion when the starter motor is switched on. The force of inertia of the driven parts located on the helically-grooved thread of the armature shaft is thereby used, and the pinion is thereby engaged.

Moreover, a Bendix starter is made known in DE 24 39 981 A1 that includes a brake device to engage the driven elements. The brake device includes a ratchet sleeve having ratchet teeth that is frictionally engaged with the tang shaft. A pawl can be swung into the geometry of the ratchet teeth by means of an electromagnet, so that, when the pawl is swung into place and the starter motor is rotating, a force acts on the circumference of the tang shaft. In cooperation with the helically-grooved thread, a propulsive power is thereby produced, with which the pinion can be engaged in a ring gear of an internal combustion engine. When the starter device is switched on, the electromagnet is switched on first; as a result, an ignition armature is pushed out of the electromagnet, which causes the pawl to swing into the ratchet teeth. As the stroke movement of the ignition armature continues, two relay contacts are closed, which causes full battery current to flow to the starter motor, the starting pinion is moved into mesh and engages and, finally, the internal combustion engine is started. The pawl is also used to prevent the starting pinion from disengaging if the loads on the ring gear of the internal combustion engine fluctuate.

The starter device disclosed in DE 24 39 981 A1 has the disadvantage that, in addition to the actual ignition switch located on the instrument panel of the vehicle, further contacts located in the starter device are required to allow full battery current to flow to the starter motor. Furthermore, when space is very tight, the electromagnet is accommodated in the drive-end bearing of the starter device. This makes a side opening in the drive-end bearing necessary. In addition, this side opening must be closed by means of a separate cover.

SUMMARY OF THE INVENTION

Using the device according to the invention, it is possible to actuate a brake device without a second switch, however. By actuating the brake device by means of a stator or rotor, no further electrical components are needed for switching. This further results in the possibility of designing the starter largely coaxial in its internal construction. Fewer parts are required which enables the device to be realized with greater ease, reliability and cost-effectiveness.

If the change in position of a starter component is used to actuate the brake device, a solenoid or a rotary magnet can be realized, for example, by means of the interaction between rotor and stator. The rotor and the stator thereby perform a double function. On the one hand, the stator and the rotor, when supplied with full battery current, effect a rotary motion of the rotor or the armature shaft and, therefore, of the starting pinion, and therefore represent the drive. On the other hand, they perform the switching function for the brake device.

When the rotor and stator are located in suitable fashion relative to each other, the rotor or the stator can be either rotated or displaced in order to actuate the brake device. As a result of this change in position resulting from reaction power, a force can be transferred to the brake device that can be used to actuate the brake. Either the rotation of the pole tube or the stator, or its displacement, or the displacement of the rotor relative to the stator can thereby be used in advantageous fashion.

A reaction power or a reaction torque of a starter component can thereby be used to rotate a keyway element and, as a result, to press brake keys against a brake drum, by way of which a braking torque can be applied to the driven shaft.

According to another advantageous embodiment, it is possible to actuate a pawl by means of the change in position of one of the starter components and thereby produce a braking torque on the rotating driven shaft in cooperation with a disk and a positive engagement occurring between pawl and disk. A simple and lightweight braking mechanism can thereby be realized.

A frictional engagement between disk and driven shaft ensures a force transmission between driven shaft and disk that is easy on the disk and the pawl.

The frictional engagement between driven shaft and disk further makes it possible for the pinion to rotate despite a tooth-on-tooth connection between the ring gear of the internal combustion engine and the driven element designed as pinion.

A disposition of a disengagement spring that is favorable in terms of installation space is given, on the one hand, by means of support on the drive-end housing side and, on the other hand, by means of support on the driven shaft.

A very good sealing of the starter or the starter motor is given when the pole tube is enclosed by a separate starter motor housing. Furthermore, the base of the pot-like starter motor housing can be designed as a bearing receptacle and, as a result, the pole tube can be supported in bearings in the starter motor housing.

The bearing element for supporting the pole tube in the starter motor housing can also be designed as a bearing for the rotor.

In order to reverse the disengagement prevention by the pawl or one or more keys toward the end of the starting procedure so that the pinion can disengage, a spring element is to be provided on the starter component changing its position that counteracts the change in position in order to actuate the brake.

BRIEF DESCRIPTION OF THE DRAWINGS

The invention is explained in greater detail hereinafter in exemplary embodiments using the accompanying drawings.

Identical or equally-acting components are labelled with the same reference numerals.

DETAILED DESCRIPTION OF THE PREFERRED EXEMPLARY EMBODIMENTS

Figure 1:
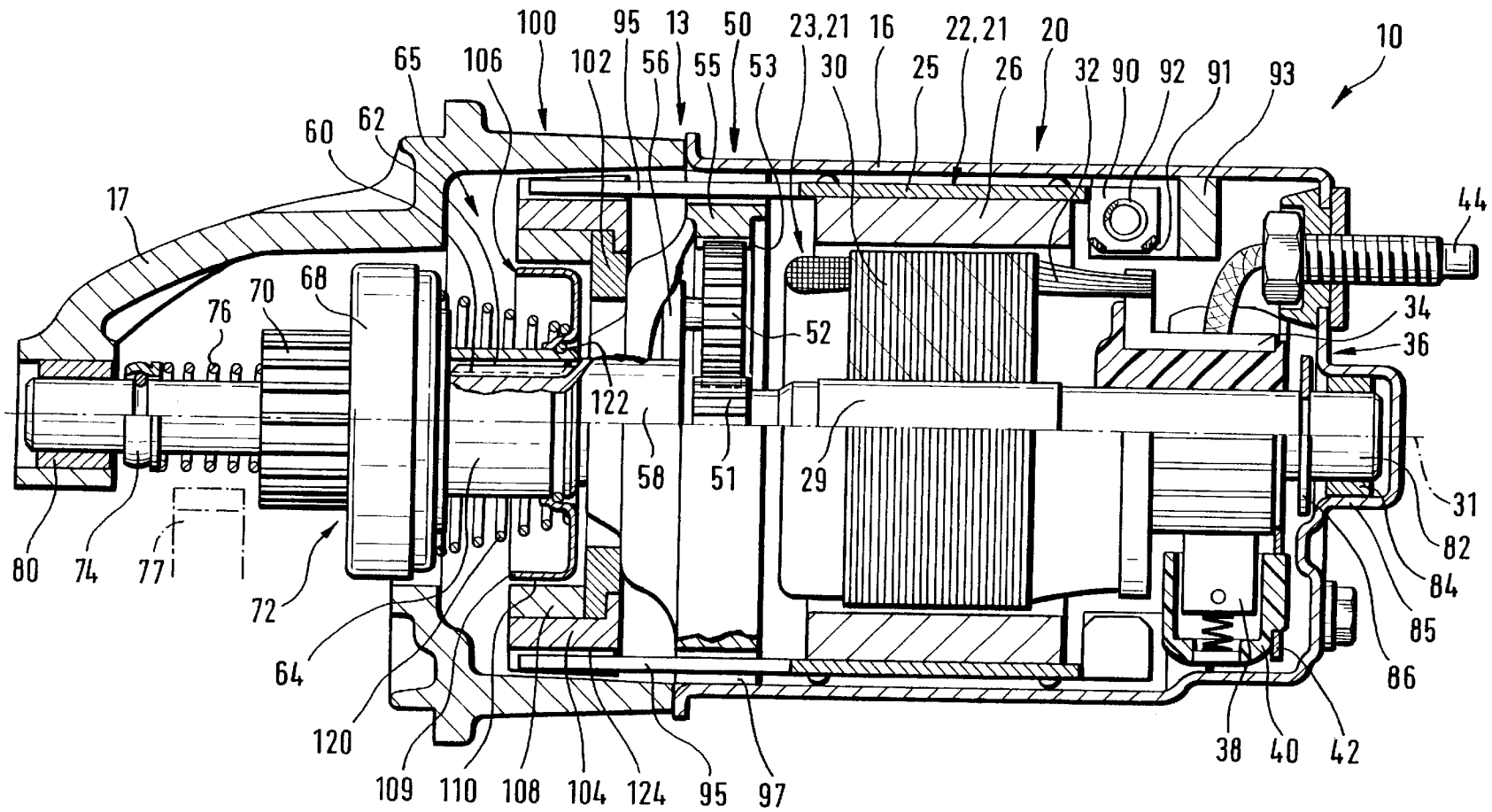
FIG. 1 is a first exemplary embodiment of the starter device according to the invention.

A first exemplary embodiment of a starter device 10 according to the invention is shown in FIG. 1. The starter device 10 has a two-part housing 13 and comprises a starter motor housing 16 and a drive-end housing 17. The starter motor housing 16 encloses a starter motor 20 that comprises a stator 22 and a rotor 23 as starter components 21. The stator 22 comprises a pole tube 25 and stator poles 26 that are designed as permanent magnets. The pole tube 25 forms the magnetic return path for the stator poles 26. The stator poles 26 are located around the rotor 23. The rotor 23 comprises a rotor shaft 29 having a rotor axle 31, to which a rotor laminated core 30 is connected in a fashion that prevents it from rotating. An armature winding 32 is placed in grooves—not shown—of the rotor laminated core 30. The armature winding 32 is composed of individual phase windings that are connected to commutator segments 34. The individual commutator segments 34, taken together, form a commutator 36. Full battery current is supplied to the armature winding via a plurality of brushes 38 located around the circumference of the commutator. The brushes 38 are inserted into tubular brush holders 40 that are secured to a brush plate 42. The brush plate 42 holds "positive brushes" as well as "negative brushes". The positive brushes can be connected to a positive pole of a starter battery—not shown—via a positive bolt 44 by means of an ignition switch, which is not shown. The negative brushes are connected to the housing 13 leading to ground.

The rotor shaft 29 is connected by way of its end facing the drive-end housing 17 to a planetary gear 50 and thereby drives a sun gear 51. The sun gear 51 meshes with planetary pinions 52 which, in turn, revolve within a ring gear 53. The ring gear 53 is integrally connected to an intermediate bearing 55. The planetary pinions 52, in turn, are held by a planetary carrier 56. The intermediate bearing 55 is situated in the starter motor housing 16 in stationary fashion and is unable to rotate. The planetary carrier 56, in turn, is connected to a drive shaft 58 in a fashion that prevents it from rotating.

The drive shaft 58 is provided with an external helically-grooved thread 60 over a certain length. Meshing into this external helically-grooved thread 60 is an internal helically-grooved thread 62 that is cut into a tang shaft 64. Together, the internal helically-grooved thread 62 and the external helically-grooved thread 60 form a "mesh drive" 65. The tang shaft 64 is connected to an outer ring of an overrunning clutch 68, via which a driven element 70 can be driven on an inner ring—not shown—of the overrunning clutch 68 by means of sprags. The driven element 70 is typically designed as a pinion. The tang shaft 64, the overrunning clutch 68, and the driven element 70 form a driven shaft 72. During operation, the driven shaft 72 glides on the external helically-grooved thread 60, the driven shaft 72 rotates and is displaced on the drive shaft 58 until it meets a stop ring 74 while overcoming a disengagement force of a disengagement spring 76. The driven element 70 is then completely engaged in a ring gear 77—indicated—of an internal combustion engine not shown in entirety. The drive shaft 58 is supported via a bearing 80 in the drive-end housing 17.

The rotor 23, with its rotor shaft 29 and a rotor shaft journal 82 pointing away from the drive-end housing 17, is supported in a bearing receptacle 85 in the starter motor housing 16 by means of a rotor bearing 84. The position of the rotor 23 toward the rotor bearing 84 is determined by means of a locking element 86.

The cylindrical pole tube 25 comprises spring hangers 90 on its end opposite to the drive-end housing 17. These spring hangers 90 are essentially offset radially from the pole tube as an integral part and have a likewise essentially rectangular shape. The spring hangers 90 comprise tabs 91 offset essentially perpendicular to the rotor shaft 29 on their end pointing radially inward toward the rotor shaft. A spring element 92 is located in an intermediate space between the tabs 91 and the starter motor housing 16. This spring element 92 is supported on an abutment 93 that is attached to the starter motor housing 16. A spring force exerted by the spring element 92 therefore acts between the abutment 93 and the spring housing 90 that counteracts a change in position of a starter component 21.

Rods 95 aligned in the direction of the rotor shaft are designed on the end of the pole tube 25 facing the drive-end housing 17. These rods 95 extend into a space between the intermediate bearing 55 and the overrunning clutch 68. For this, the intermediate bearing 55 comprises longitudinal openings 97 on its outer circumference in the circumferential direction.

A brake device 100 is located between the intermediate bearing 55 and the overrunning clutch 68. The brake device 100 comprises a retaining ring 102 that is secured to an intermediate bearing 55 and is concentric to the rotor shaft 29, a keyway element 104 supported on this retaining ring 102 in rotatable fashion, and brake keys 108 located between a brake drum 106 and the keyway element 104. The brake keys 108 are coupled to the retaining ring 102 in rotatable fashion and are guided toward the brake drum 106 and behind it by means of a guide that is not shown.

The brake drum 106 comprises a cylindrical ring 109 having a surface 110 oriented toward the outside. The cylindrical surface 110 represents a friction surface for the brake keys 108.

Figure 2:
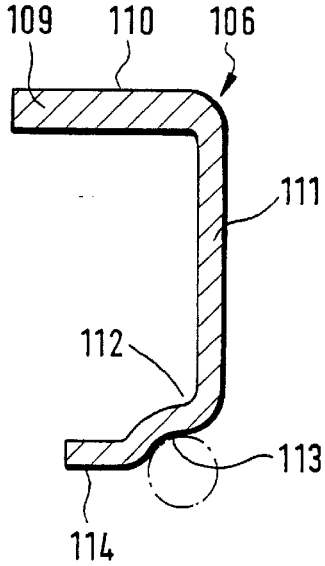
FIG. 2 is a cross-sectional view through a part of the brake device according to the first exemplary embodiment.

As shown in FIG. 2, the ring 109 turns into a flange 111 oriented radially inward, the radially-inward oriented end of which abuts a short cylindrical section oriented toward the overrunning clutch 68. This section forms a spring seat 112 oriented toward the driven element 70. An area that continues to taper abuts this spring seat 112, which area ends in a short cylindrical section. A retaining seat 113 is provided on the side of the tapering area opposite to the overrunning clutch 68. The short cylindrical end represents a guide 114. The brake drum 106 thereby has an essentially U-shaped ring cross-section that is open toward the overrunning clutch 68.

A spring 120 is supported on the spring seat 112 of the brake drum 106, which spring 120 is supported on the outer ring of the overrunning clutch 68 with its other end facing the driven element 70. With the retaining ring seat 113, the brake drum is supported on the cam shaft 64 due to the spring force of the spring 120 on a retaining ring 122. The force exerted by the spring 120 effects a non-positive engagement between the brake drum 106 and the snap ring 122 and, therefore, between the brake drum 106 and the cam shaft 464 64. A force acting on the brake drum 106 or a tongue acting on the brake drum 106 is thereby transferred—at least partially—to the cam shaft 64 and the meshing drive 65. The guide 114 prevents the brake drum 106 from tilting on the cam shaft 64.

The rods 95 of the pole tube 25 extending through the openings 97 mesh into grooves 124 of the keyway element 104.

If full battery current is supplied to the starter device described in FIG. 1 by closing the ignition switch, i.e., if electrical current flows through the armature winding 32, torque occurs between the rotor 23 and the stator 22 or the stator poles 26. This torque acting between the stator 22 and the rotor 23 effects forces acting in the circumferential direction between these two. As a result, the rotor 23 rotates in the specified direction of rotation, and the stator 22—which is supported on bearings so that it is free to rotate around the rotor shaft 29—moves against the direction of rotation of the rotor 23 and, therefore, against the spring force of the spring element 92. The spring element 92 is thereby loaded between the abutment 93 and the spring hanger 90 on the displaced pole tube. The rods 95, which are integrally connected to the pole tube 25, are also rotated in accordance with an angle of rotation of the pole tube 25, they actuate the brake device 100 and thereby effect a rotation of the keyway element 104 around the retaining ring 102. The keyway element 104 thereby effects a clamping force between the keyway element 104, the brake keys 108, and the brake drum 106. The drive shaft 58, which rotates simultaneously with the rotating rotor shaft 29, effects a rotation of the tang shaft 64 by means of the meshing drive 65. The clamping force exerted on the brake drum 106 by the brake device 100 leads to a friction force acting on the circumference of the tang shaft 64 and, therefore, to a braking torque. In combination with the meshing drive 65, this friction force inevitably effects a moving into mesh of the driven element 70 and, therefore, a meshing into the ring gear 77.

If the driven element 70 is meshed into the ring gear 77, the brake drum 106 has moved toward the ring gear 77 to the extent that the brake keys 108 are then moved behind the flange 111 and, therefore, between the flange 111 and the intermediate bearing 55. If the brake keys 108 have fallen behind the flange 111, a friction force is no longer applied by the brake device 100 to the tang shaft 64. The starter motor 20 can now freely drive the driven element 70 and, therefore, the ring gear 77.

As long as the starter device 10 remains switched on by means of the ignition switch and, therefore, during the entire starting procedure, the brake device 100 and, therefore, the brake keys 108 remain in a position that prevents the driven element 70 from disengaging. When the starter device 100 is switched off, the electromagnetic field between the pole tube 25 or the stator 22 and the rotor 23 collapses. The force of the spring element 92 begins to exceed the force between the stator 22 and the rotor 23, which is why the rotation of the stator 22 or the pole tube 25 is returned to the initial position. The rods 95 also rotate the keyway element 104 back to its initial position. The brake keys 108 are again lifted radially outward. The disengagement spring 76 then causes the driven shaft 72 to return to the initial position.

Figure 3:
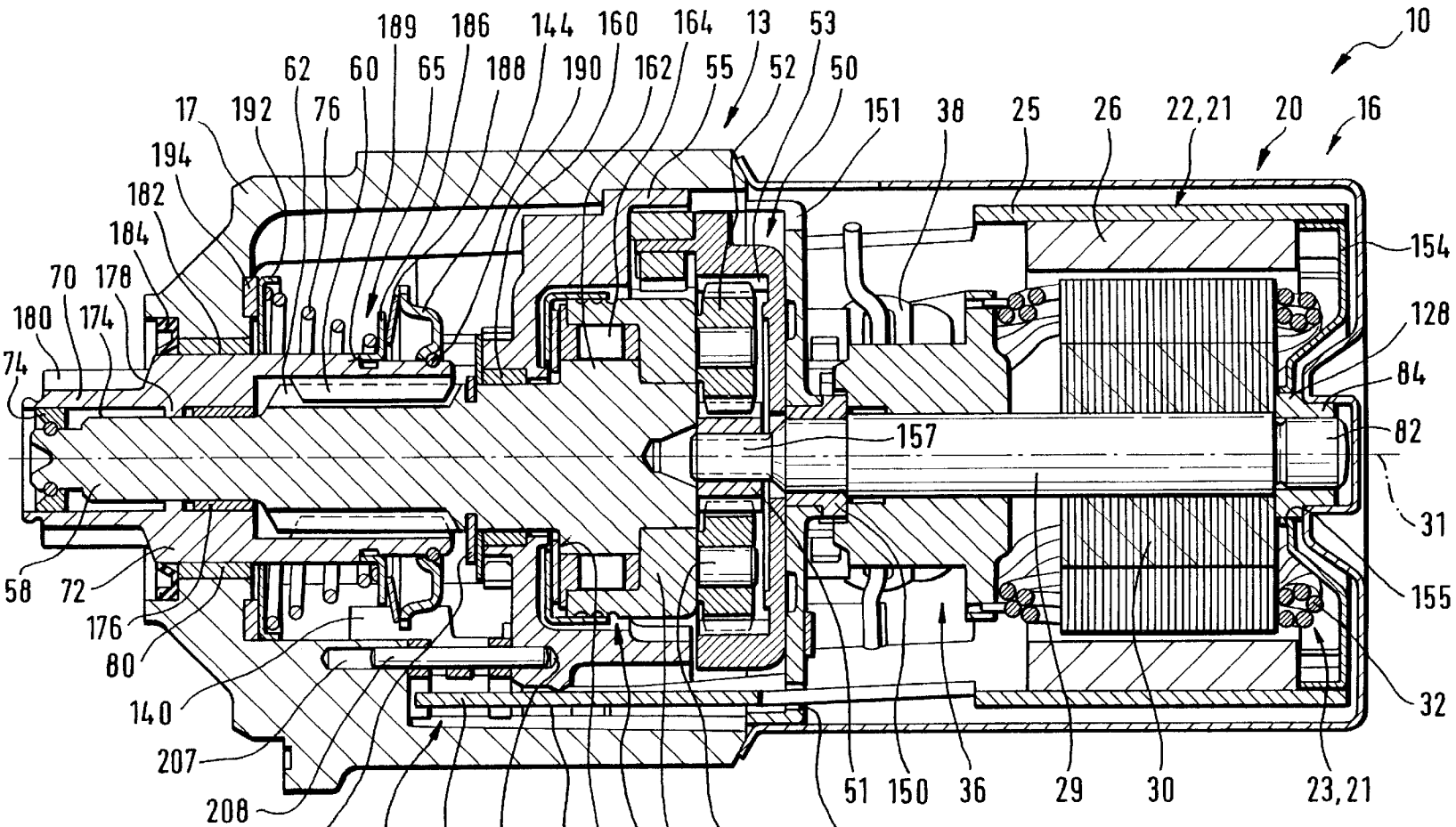
FIG. 3 is a second exemplary embodiment.

A second exemplary embodiment of the starter device 10 according to the invention is shown in FIG. 3. In this case as well, the two-part housing 13 encloses the starter motor housing 16 and the drive-end housing 17. The starter motor 20 is located in the starter motor housing 16 with the starter components 21, stator 22, and rotor 23. In this case as well, the pole tube 25 with the stator poles 26 is supported in such a fashion that it is free to rotate around the rotor axle 31. The rotor shaft 29 is supported via the rotor bearing 84 in the bearing receptacle 85 of the starter motor housing 16 with its rotor shaft journal 82, that is, with the end opposite to the drive-end housing 17. This is supported via a commutator end shield 150 with its end of the rotor shaft 29 facing the drive-end housing 17. The commutator end shield 150 is placed in a commutator end shield receptacle 151. The commutator end shield receptacle 151 is pressed into the starter motor housing 16. Support of the rotor 23 is thereby unequivocally established. The starter motor 20 thereby represents a separate, complete unit that can be preassembled.

The rotatable pole tube 25 has a basically cylindrical form and comprises a bearing flange 154 used on the end opposite to the drive-end housing 17. In its axial center, this bearing flange 154 has a central opening with a bearing ring 155 extending in cylindrical fashion. The pole tube 25 is supported on the bearing element 128 by means of this bearing ring 155 in such a fashion it can rotate. The bearing element 128 and the rotor bearing 84 are designed integrally connected. As shown in the exemplary embodiment in FIG. 1, rods 95 extend in the axial direction from the pole tube 25 in the direction of the drive-end housing 17. These rods 95 extend through the commutator end shield receptacle 151 and its openings 97.

The rotor shaft 29 has a positive-engagement element 157 on its end facing the drive-end housing 17, with which a positive shaft-hub engagement is realized. The positive-engagement element 157 is designed in this case as multi-tooth.

The sun gear 51 is placed on the positive-engagement element 157. The sun gear 51 drives a plurality of planetary pinions 52 located around the sun gear 51. The planetary pinions 52, in turn, mesh with the ring gear 53, which is solidly situated in the drive-end housing 17.

The intermediate bearing 55—situated in the drive-end housing 17 in a fashion that prevents it from rotating—has a central opening through which the drive shaft 58 extends. A bearing 160 is located between the drive shaft 58 and the intermediate bearing 55 to support the bearing forces. The intermediate bearing 55 is designed essentially in the shape of a pot and is open toward the starter motor 20. The pot-shaped intermediate bearing 55 accommodates the overrunning clutch 68 in its interior. An internal ring 162 of the overrunning clutch 68 is designed integrally connected to the drive shaft. Sprags 164 connect the inner ring 162 with the outer ring 166 of the overrunning clutch 68. The outer ring 166, in turn, carries planetary carrier axles 168 on its front facing the starter motor 20, on which the planetary pinions 52 glide.

The position of the drive shaft 58 with regard for the intermediate bearing 55 is specified, on the one hand, by a face 170 of the inner ring 162 oriented toward the drive element and, on the other, by a snap ring 172. The external helically-grooved thread 60 follows the snap ring 172 in the axial direction toward the driven element 70, into which the driven shaft 72 meshes with its internal helically-grooved thread 62. A cylindrical sliding surface 174 follows the external helically-grooved thread 60 on smaller-diameter shaft section, on which the driven shaft 72 is supported by means of a driven shaft bearing 176. The position of the driven shaft bearing 176 is determined, on the one hand, by the larger-diameter external helically-grooved thread 60 and, on the other hand, by an inner collar 178 on the driven shaft 72. A short shaft section that is even smaller in diameter follows the cylindrical sliding surface 174, on which the stop ring 74 is secured by means of a snap ring. In cooperation with the inner collar 178, this stop ring 74 determines the disengaged end position of the driven element 70.

An outer side of the driven shaft 72 is essentially divided into three sections. First, the driven element 70—shown here as pinion 180—is located on the end of the driven shaft 72 opposite to the starter motor 20. Another cylindrical sliding surface 182 follows on a larger-diameter section in the direction toward the starter motor 20, on which a shaft sealing ring 184 and, located behind this, the bearing 80, slide. The shaft sealing ring 184 is pressed into the drive-end housing 17 and protects the inside of the starter device 10 from foreign materials entering from the outside. The bearing 80 is also pressed into the drive-end housing 17 and is protected by the shaft sealing ring 184.

A plurality of elements is located one after the other on the end of the driven shaft 72 facing the starter motor 20. In axial sequence, a ring 186 having an L-shaped cross-section comes first, then a spring element 188 in the form of a diaphragm spring, followed by the disk 144. The ring 186, the spring element 188, and the disk 144 are loaded against each other by the diaphragm spring 188 and are supported in the axial direction toward the driven element 70 on a collar 189 forming a first axial stop and, in the direction toward the starter motor 20, on a locking element 190 forming a second axial stop. On the one hand, the spring element 188 thereby presses the ring 186 against the flange and, on the other, it presses the disk 144 against the locking element. The disk 144 is connected with the driven shaft 72 in frictionally engaged fashion.

The ring 186 has one leg extending in the axial direction that lies on the driven shaft 72. A further leg extends radially outward. Both legs form a corner that is open toward the bearing 80. The disengagement spring 76 is supported in this corner of the ring 186 with its first end oriented toward the starter motor 20. With its second end oriented toward the driven element 70, the disengagement spring 76 is supported on a plate washer 192 provided with an outer collar. The plate washer 192, in turn, is supported on the drive-end housing 17 via a relative washer 194 with its outer surface oriented toward the driven element 70.

Figure 4:
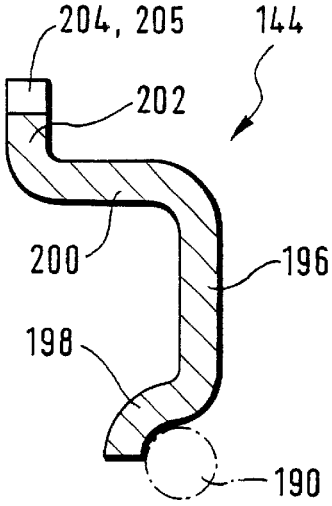
FIG. 4 is a cross-sectional view through a part of the brake device according to the second exemplary embodiment.

The cross-section of the disk 144 is shown in an enlarged view in FIG. 4. The disk 144 has a ring cross-section that is essentially U-shaped, which is open toward the driven element 70. A radially inside leg 198 and a radially outside leg 200 extend from a section 196 designed in the shape of a washer. The radially inside leg 198 partially grips the locking element 190 with its side opposite to the driven element 70. The radially outside leg 200 turns into an end leg 202 extending radially outward. The end legs 202 end in teeth 204.

Figure 5:
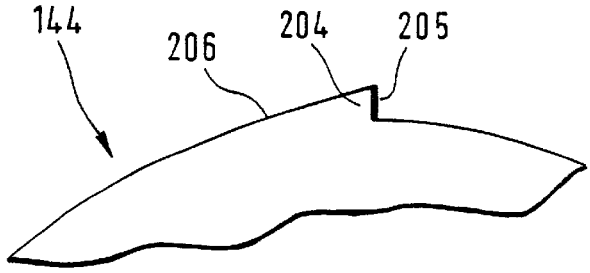
FIG. 5 is a side view of the part in FIG. 4.

A sectional representation of the disk 144 is shown in FIG. 5. The teeth 204 are designed as "saw teeth". These teeth have a front face 205 aligned essentially radially, and a tooth back side 206 extending nearly in the circumferential direction.

A spindle 208 is inserted with a first end in a blind hole 207 on the inner circumference of the drive-end housing 17. By way of a second end, the spindle 208 is supported in a blind hole 210 in the intermediate bearing 55. The spindle 208 is aligned parallel to the rotor axle 31. An exposed length of the spindle 208 extends into an intermediate space between the support of the spindle 208 in the drive-end housing 17 and the intermediate bearing 55. The pawl 140 is located on the spindle 208 in rotatable fashion between the drive-end housing 17 and the intermediate bearing 55.

Figure 6:
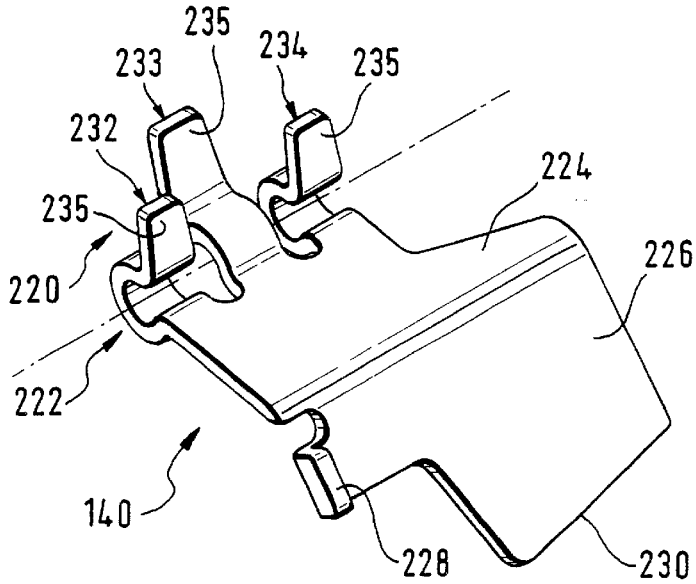
FIG. 6 is a perspective view of the pawl according to the second exemplary embodiment.

The pawl shown in FIG. 6 has a band hinge 222, a connecting part 224, and a control part 226. The connecting part 224 and the control part 226 are aligned parallel to the spindle 208. A support part 228 is integrated with the control part 226 and forms a right angle with the control part 226. The control part 226 has a control edge 230 that interacts with the teeth 204. The band hinge 22 comprises three tabs 232, 233, and 234, which fulfill two different tasks. On the one hand, they form the band hinge 222, with which the pawl 140 is supported in a fashion that allows it to rotate around the spindle 208. For this, the tabs 232 and 234 encompass the spindle 208 in a first direction, and tab 233 located between the tabs 232 and 234 encompasses the spindle 208 in a second direction. As a result, the spindle 208 is completely encompassed by the tabs 232, 233, and 234. The tabs 232, 233, and 234 have tab ends 235 that protrude in a radial direction relative to the spindle 208. The tab ends 235 of the tabs 232 and 234 encompass the rod 95 in circumferential direction from a first side. The tab end 235 of the tab 233 encompasses the rod 95 from a second side as viewed in the circumferential direction. This arrangement of the tab ends 235 produces a rod receptacle 220. In FIG. 6, the control edge 230 is not aligned parallel to the spindle 208; instead, it encompasses a sharp angle with the axis of the spindle 208 in the direction toward the driven element 70. The non-parallel, angular direction of the control edge 230 results in an additional force component between the control edge 230 and the disk 144 in the moving-into-the-mesh direction, wherein an effectiveness of the moving-into-the-mesh is increased without simultaneously hindering the later disengagement. By way of its right-angled projection from the control part 226, the support part 228 increases the size of seating surface of the pawl 140 on the intermediate bearing 55. As a result, signs of wear on the intermediate bearing 55 as well as on the pawl 140 are diminished.

Figure 7:
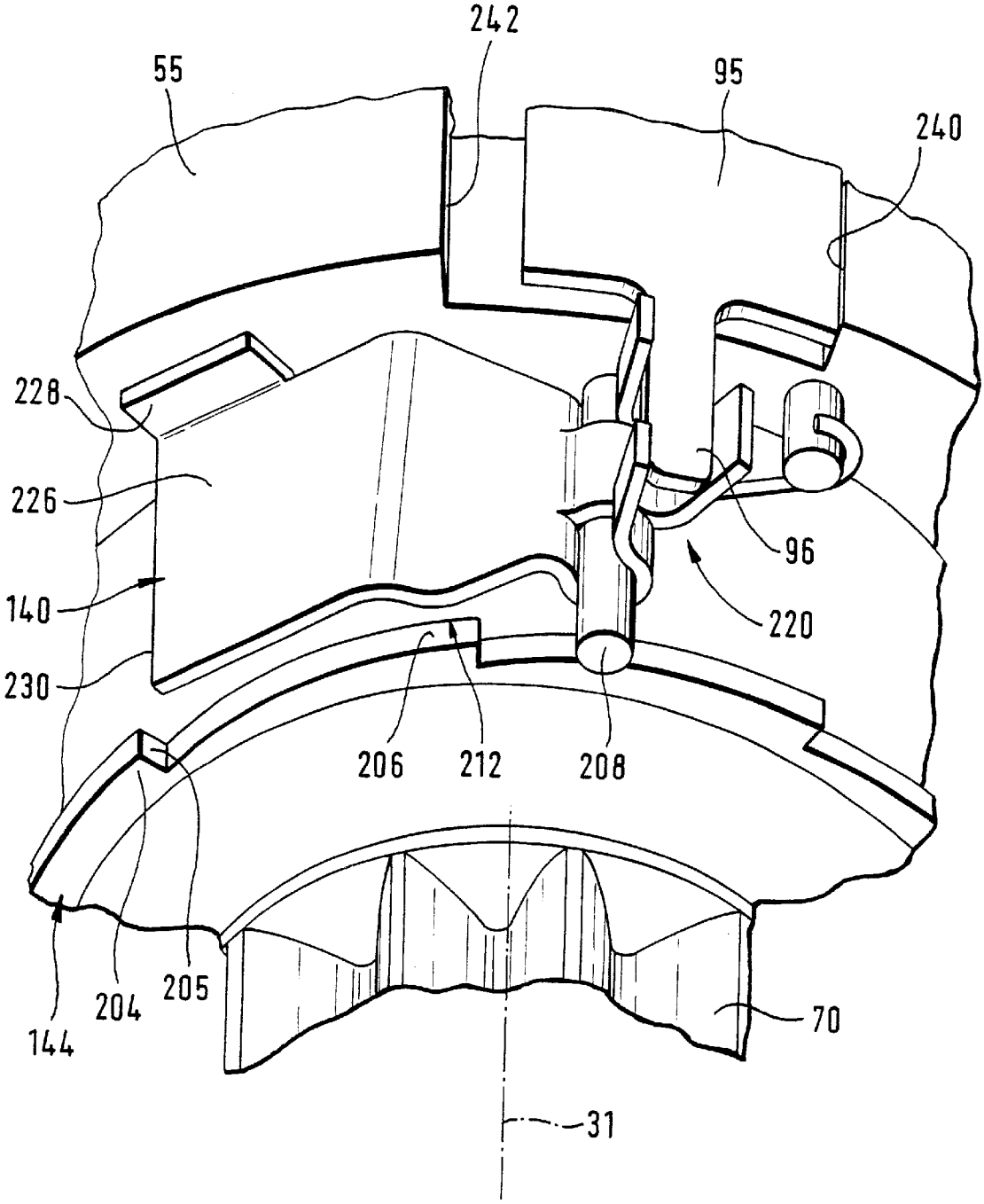
FIG. 7 is a perspective view of a variant of the pawl in FIG. 6.

A second exemplary embodiment of the pawl 140 is shown in FIG. 7. The essential difference from the exemplary embodiment according to FIG. 6 is that the control edge 230 is aligned parallel to the axial direction of the spindle 208.

With their three outwardly-directed ends, these three tabs of the pawl 140 form a rod receptacle 220 extending in the axial direction, into which the rod 95 grips.

If the rod 95 rotates around the rotor axle 31, this causes the pawl 140 to rotate around the spindle 208 in counter-clockwise direction. The control part 226 thereby finally comes to be seated on the back side of the tooth 206, so that the front face can come to be seated against the control edge 230.

Figure 7A:
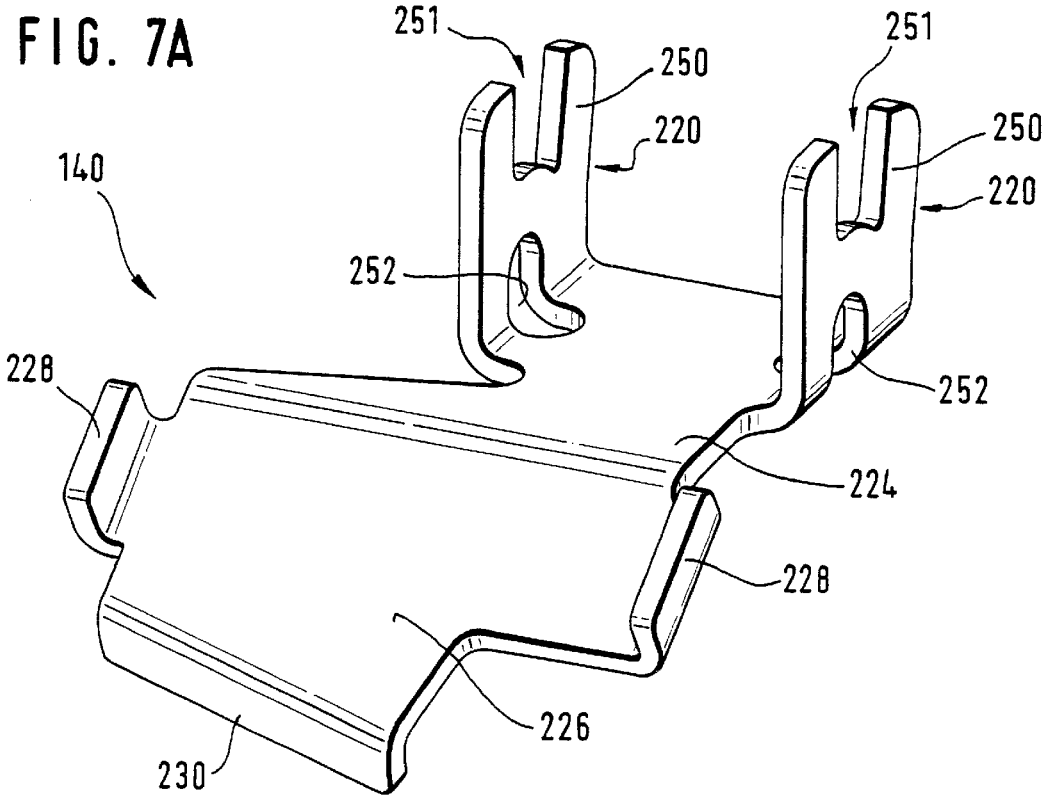
FIG. 7A is a third exemplary embodiment of the pawl.

A third exemplary embodiment of the pawl 140 is shown in FIG. 7A. Two tabs 250 are integrally connected to the connecting part 224. The one tab 250 is oriented toward the drive-end housing 17, and the other tab 250 is oriented toward the intermediate bearing 55. Both of them extend parallel to each other and are aligned essentially radially. The radially outwardly-directed ends of the tabs 250 are provided with slits 251 open radially outward, which, together, form the rod receptacle 220.

Both tabs 250 contain holes in the transition from the tabs 250 to the connecting part 224, and both holes 252 are located so that the spindle 208 can be slid through.

As described for FIG. 6, the control part 226 abuts the connecting part 224. Two opposing support parts 228 are now integrally moulded to this, which are supported on the intermediate bearing 55 on the one hand and, on the other, behind the disk 144 when the driven element 70 is fully engaged.

Again, a control edge 230 is integrally moulded to the control part 226. In this exemplary embodiment, this is bent away from the control part 226. The control edge 230 is now no longer formed by a shearing surface produced by stamping, as is the case in the two preceding examples, but, instead, it is an area of the sheet-metal surface of the basic material of the pawl 140. The control edge 230 again extends at an angle and supports the moving into mesh of the driven element 70.

Figure 7B:
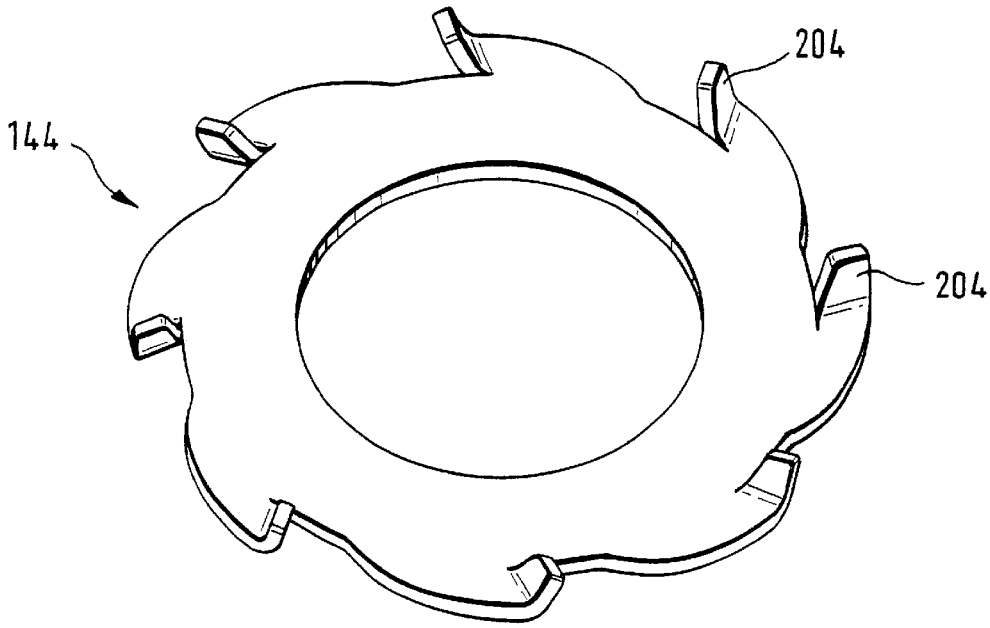
FIG. 7B is a perspective view of a further exemplary embodiment of the part in FIG. 4.

A perspective view of a further exemplary embodiment of the disk 144 is shown in FIG. 7B. The disk 144 comprises teeth 204 evenly distributed around its circumference. In contrast to the embodiment disclosed previously, the disk 144 is essential flat and has teeth 204 that are bent out of the disk material. The teeth 204 stand at an angle; they are adapted to the angular control edge 230, and they therefore comprise a slope.

Figure 7C:
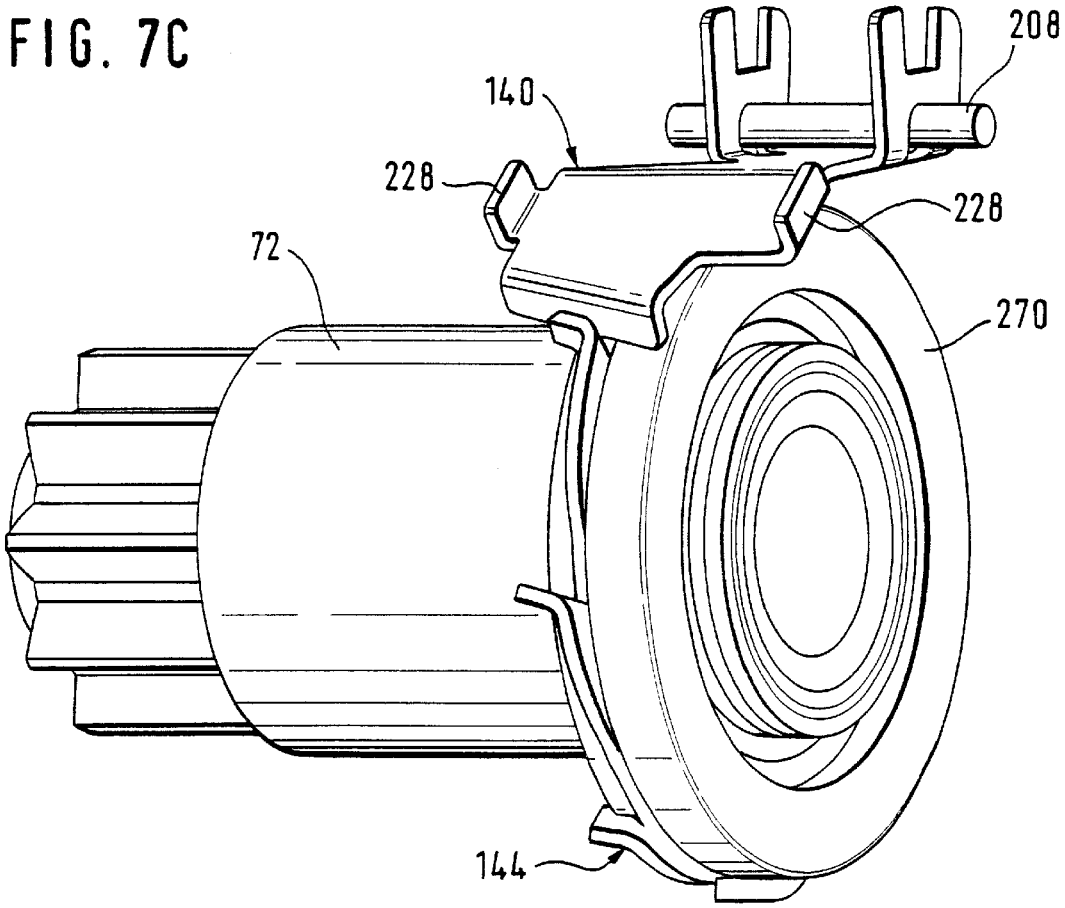
FIG. 7C is a perspective view of the driven shaft.

A perspective view of the driven shaft 72 is shown in FIG. 7C. The pawl 140 described for FIG. 7A is thereby engaged with the disk 144 described for FIG. 7B. A stop disk 270 is also installed on the tang shaft 64 as a friction bearing behind the disk 144, i.e., in the direction toward the starter motor 20. This stop disk 270 serves to keep the speed acting on the support part 228 as low as possible when the driven element 70 is fully engaged and the support part 228 is then supported on it.

Figure 7D:
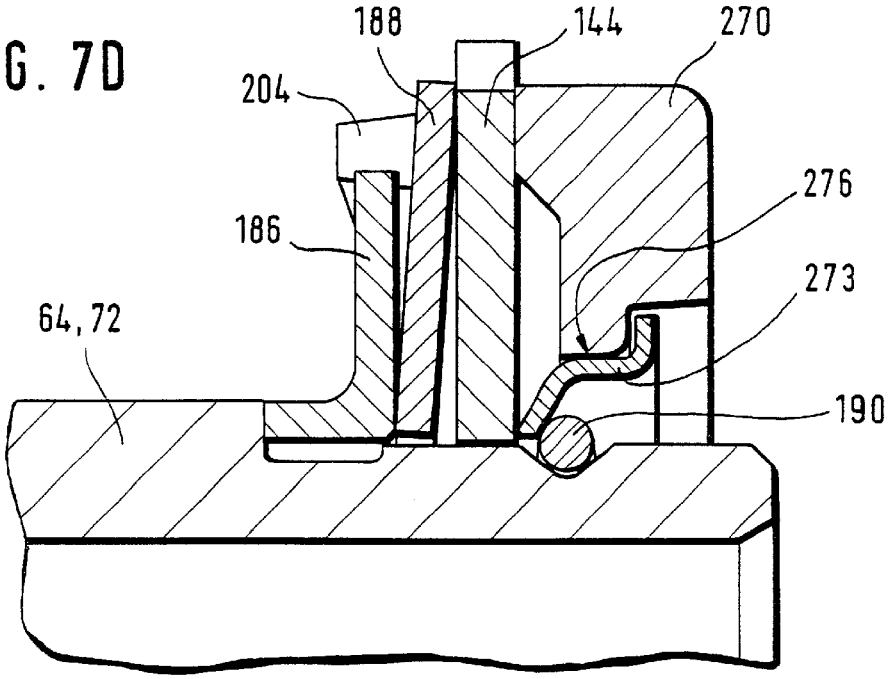
FIG. 7D is a cross-section through the part of the brake device on the tang shaft side.

A cross-section through the part of the brake device 100 on the driving-shaft side according to FIG. 7C is shown in FIG. 7D. From the description of FIG. 3 it is already known that the L-shaped support ring 186 is supported on a first axial stop toward the driven element 70. The spring element 188, in the form of the diaphragm spring, abuts it. The spring element 188 is supported on the disk 144, which is designed according to FIG. 7B. In deviation from FIG. 3, a retaining ring 273 is in contact, and it is supported on a locking element 190. The retaining ring 273 comprises a radially outwardly-directed recess 276, on which the stop disk 270 is located. The stop disk 270 is guided through the retaining ring 273 with play in the radial and axial direction.

Figure 8:
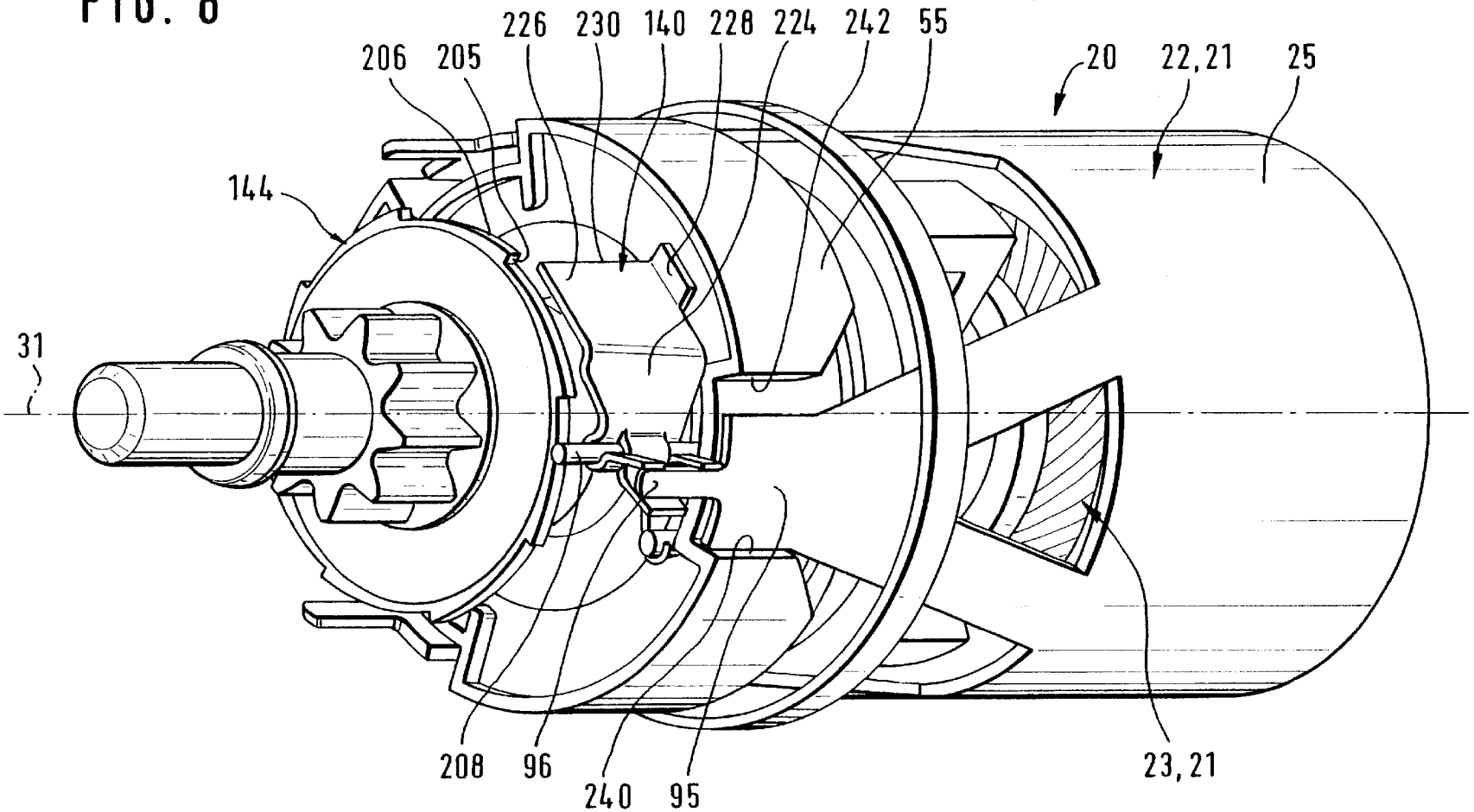
FIG. 8 is a perspective view of the internal components of the second exemplary embodiment in stationary position, FIG. 9 are the internal components of the second exemplary embodiment after the pawl latches into the brake mechanism.

The function of the brake device 100 of the second exemplary embodiment will be explained in greater detail hereinafter using FIGS. 8, 9, and 10. First, the stationary position of the starter device 10 is shown in FIG. 8. Battery current is not supplied to the starter motor 20 nor, therefore, the rotor 23, and the rod 95 lies against a stationary-position stop 240 with a flank oriented in the clockwise direction. The spring element 92, which is not shown in this figure, presses the pole tube 25 with the rod 95 against the stationary-position stop 240. The rod 95 grips with its rod end 96 into the rod receptacle 220 of the pawl 140. The pawl 140 is also located in its stationary position and is therefore lifted, with its control part 226, away from the tooth back side 206 and, therefore, from the disk 144.

Figure 9:
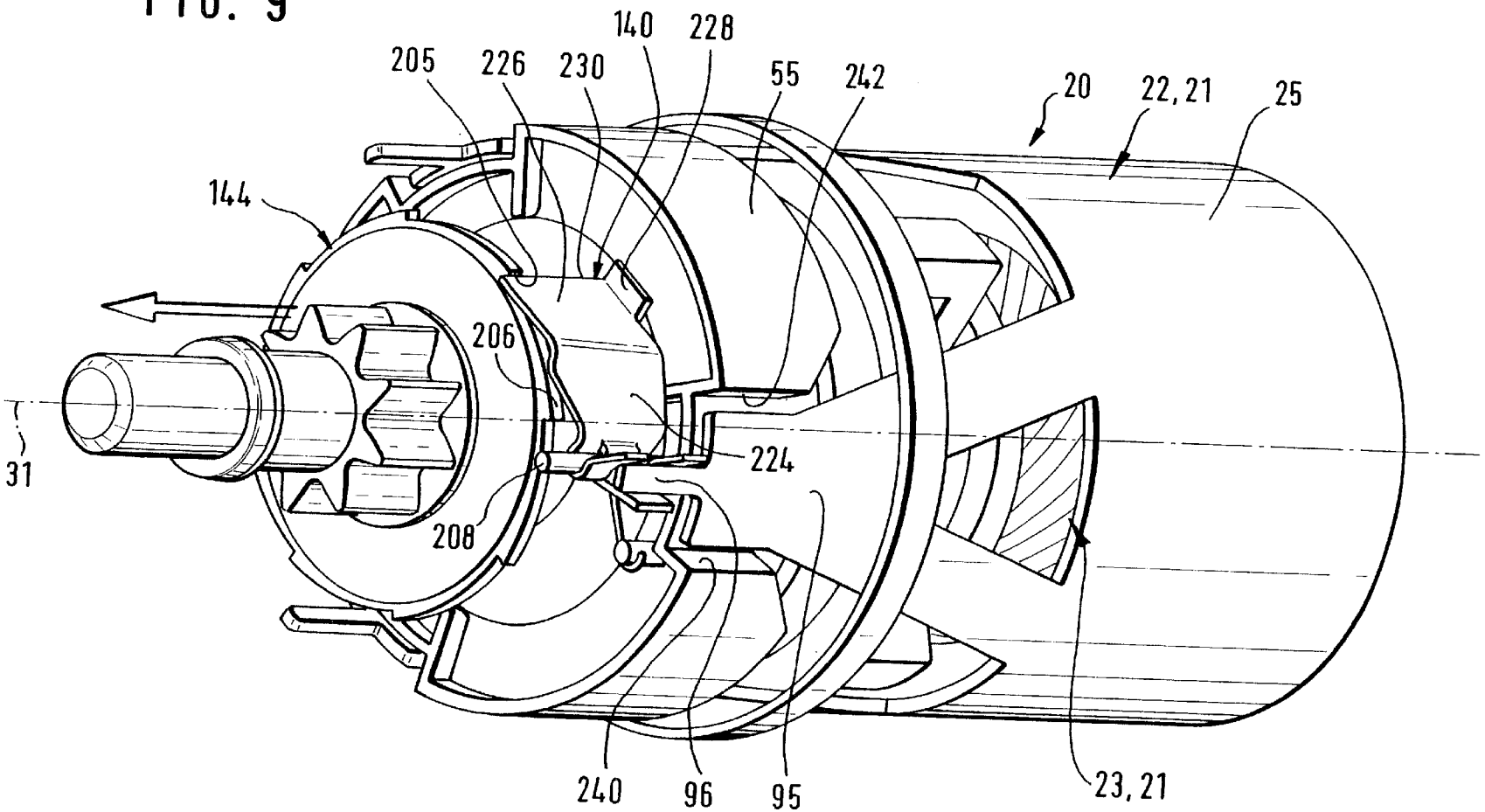
Figure 10:
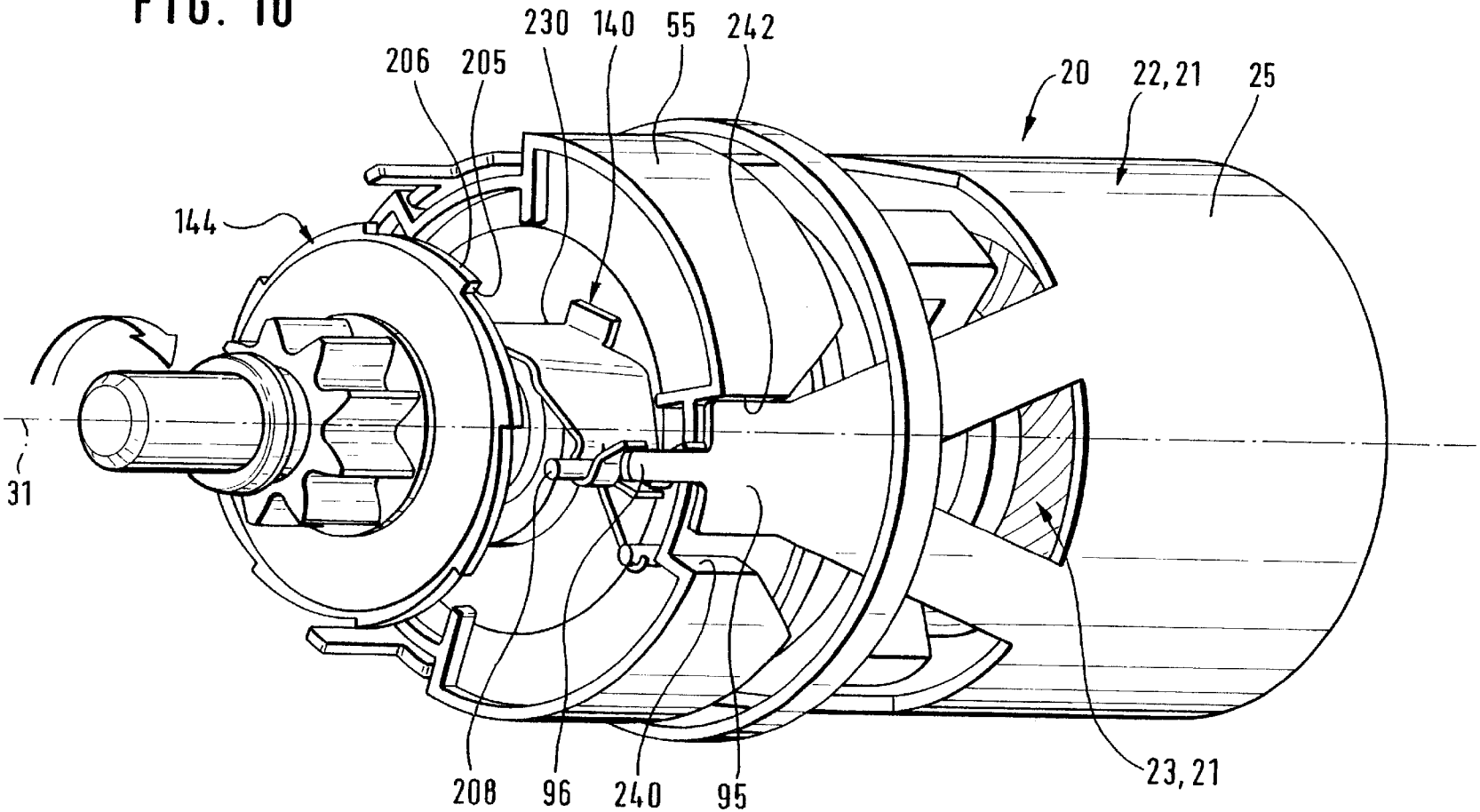
FIG. 10 is a view of the internal components of the second exemplary embodiment with locked driven element.

If battery current is now supplied to the starter motor 20 and, therefore, the rotor 23—refer to FIG. 9 as well—the rotatable pole tube 25 moves around the rotor axle 31 in counter-clockwise direction, overcomes the opposing force of the spring element 92, and leaves its stationary-position stop 240. The rod end 96 integrally connected to the pole tube 25 also rotates in the counter-clockwise direction, and the pawl 140 therefore moves or rotates on the spindle 208 in the counter-clockwise direction as well, so that the control part 228 with the control edge 230 comes to be seated on one of the tooth back sides 206 of the disk 144. The rotor 23—rotating freely at the same time—causes the disk 144, which is carried along via friction, to rotate in the clockwise direction. The front face 205 of one of the teeth 204 thereby comes to be seated on the control edge 230 of the pawl 140. This frictional engagement prevents the disk 144 from rotating, and a brake torque acts on the rotating driven shaft 72. Due to the friction ratios between the disk 144 and the driven shaft 72, a force is now produced in the meshing drive 65 that inevitably moves the driven shaft 72 into mesh. The moving-into-the-mesh force can be favorably influenced by the shape of the control edge 230, e.g., by means of an oblique part according to the description of FIG. 6. The driven shaft 72 moving into the mesh carries the disk 144 along and tracks the disk 144 along the control edge 230—refer to FIG. 9 as well—until the pawl 140 can fall behind the disk 144, that is, between the disk 144 and the intermediate bearing 55 or it can be pressed by the rod end 95—refer to FIG. 10 as well. The rod 95 thereby comes to be seated with its flank facing the counter-clockwise direction on the working stop 242.

By means of its position between the disk 144 and the intermediate bearing 55, the pawl 140 therefore prevents the driven shaft 72 from moving backward.

As long as the starter device 10 remains switched on by means of the ignition switch and, therefore, during the entire starting procedure, the brake device 100 and, therefore, the pawl 140, remain in a position that prevents the driven element 70 from disengaging. When the starter device 100 is switched off, the electromagnetic field between the pole tube 25 or the stator 22 and the rotor 23 collapses. The spring element 92 effects a resetting of the pole tube 25, the rod 95 with its rod end 96 and, therefore, a rotation of the pawl 140 in the clockwise direction. If the pawl 140 is completely removed from the intermediate space between the disk 144 and the intermediate bearing 55, the disengagement spring 76 eventually effects a resetting of the driven shaft 72 into the initial position.

Figure 11:
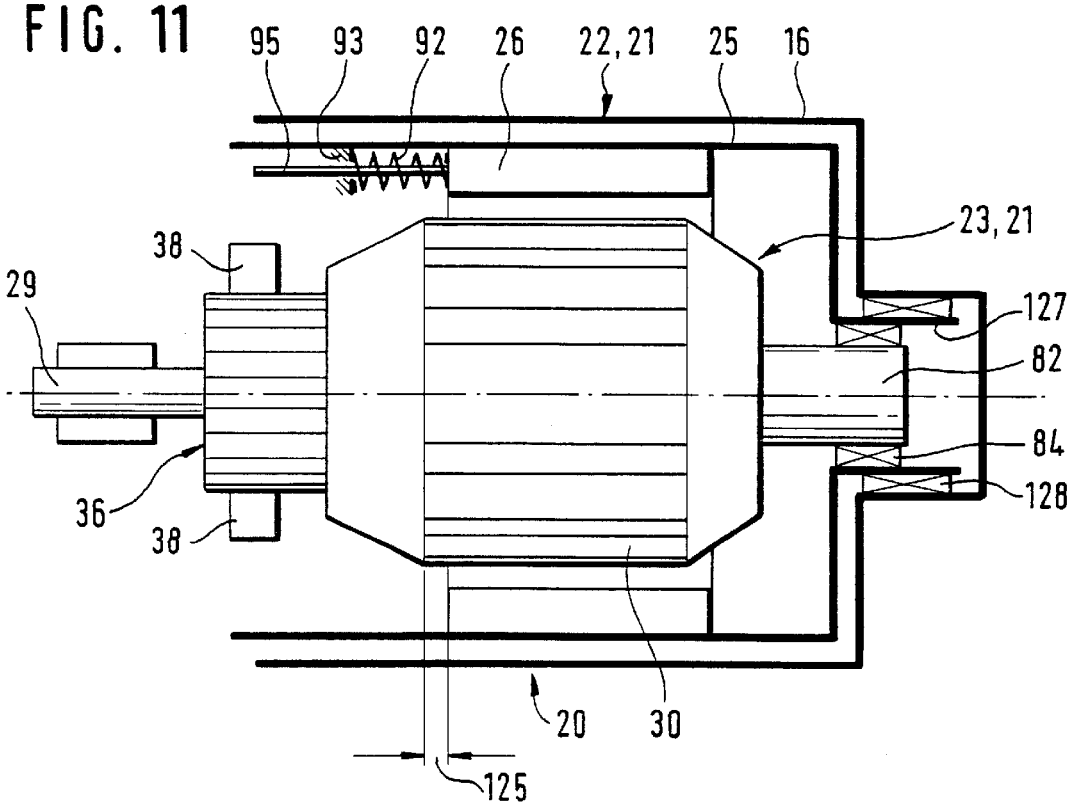
FIG. 11 is a second exemplary embodiment for producing a pawl actuating force.

While, in FIG. 1, the rods 95 for actuating the brake device 100 as a result of the rotation of the pole tube 25 also perform a rotary motion, FIG. 11 shows how a linear motion of the rods 95 can be achieved by means of the starter motor 20 and its starter components 21, i.e., by means of the stator 22 and the rotor 23.

Since the only purpose of FIG. 11 is to indicate how this linear motion of the rods 95 can be achieved, the starter device 10 is shown only in a sectional view.

Here as well, the starter motor 20 comprises the rotor 23 and the stator 22, which are situated concentric to each other. The rod 95 is firmly connected to the stator 22 and extends in the direction of the rotor shaft 29. Here as well, the stator 22 is supported firmly in the housing against an abutment 93 by means of the spring element 92. While the rotor 23 and the stator 22 are aligned in symmetry with each other with their electromagnetically active parts, the rotor 23 and the stator 22 are offset from each other in the axial direction by a displacement length 125. The rotor 23 is fixed in its axial position by means of elements that are not shown. If the starter device 10 is now switched on and, as a result, battery current flows to the rotor 23 via the brushes 38 and the commutator 36, an electromagnetic interaction results between the rotor 23 and the stator 22. Electromagnetic lines of flux flow between the rotor laminated core 30 and the stator poles 30 or the pole tube 25 with the objective of taking the shortest possible path. As a result of this objective of the lines of flux, a force of attraction results between the rotor laminated core 30 and the stator poles 26 which, due to the displacement of the rotor 23 and the stator 22 from each other, [verb missing] a radial or tangential component—as is the case in the exemplary embodiment in FIG. 1 only—as well as an axial component. This axial component of the force of attraction between rotor 23 and stator 22 causes the pole tube 25 with the stator poles 26 to move in the axial direction toward the commutator 36. This movement of the pole tube 25 leads to the same movement of the rod 95 toward the drive-end housing 17, which is not shown. The force of the spring element 92 must thereby be overcome.

As shown later in FIG. 13, this movement of the rod 95 is used to actuate the brake device 100.

When the pole tube 25 moves, a bearing shoulder 127 glides on the rotor bearing 84. Moreover, the bearing shoulder 127 glides on the bearing element 128, with which the pole tube 25 is supported in the starter motor housing 16.

Figure 12:
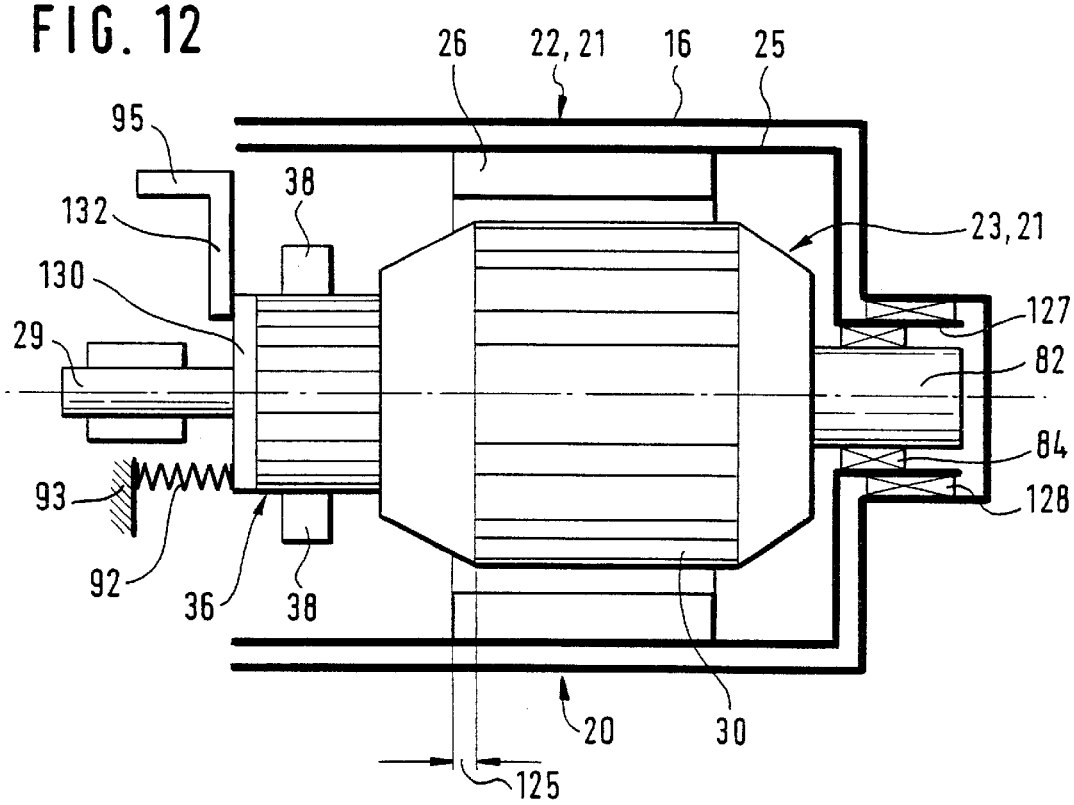
FIG. 12 is a third exemplary embodiment for producing a pawl actuating force.

An axial force is achieved in similar fashion using the starter motor 20 in FIG. 12, with which the rod 95 can be shifted. While the rotor 23 is fixed axially in FIG. 11, and the stator 22 is located with the axial displacement length 125 toward the rotor 23, in FIG. 12, the stator 22 is fixed in its axial position by means of elements that are not shown and, at the same time, the rotor 23 is situated so that it is offset axially with an axial displacement length 125 toward the stator 22. In the exemplary embodiment according to FIG. 12, the rotor 23 is therefore situated so that it can be axially displaced. Similar to the electromagnetic conditions occurring with the starter motor 20 in FIG. 11, an axial force component is also produced in the direction toward the drive-end housing 17—not shown—when battery current is supplied to the rotor 23 via the brushes 38. Since the stator 22 is fixed in the exemplary embodiment according to FIG. 3, this axial force component between the rotor 23 and the stator 22 leads to an axial displacement of the rotor 23 in this case until the axial force component becomes zero by means of a symmetrical alignment of rotor 23 and stator 22. This applies for the exemplary embodiment according to FIG. 11 as well.

This axial force is transferred from the rotor 23 to a leg 132 that is firmly connected to the rod 95 via a relative washer 130 that is supported in rotatable fashion opposite to the rotor 23. In this exemplary embodiment, the spring element 92 is supported between the abutment 93 and the relative washer 130. As described for the exemplary embodiment in FIG. 11, an axial motion of the rod 95 is therefore achieved and the brake device 100 is therefore actuated by a change in position of the rotor 23.

Figure 13:
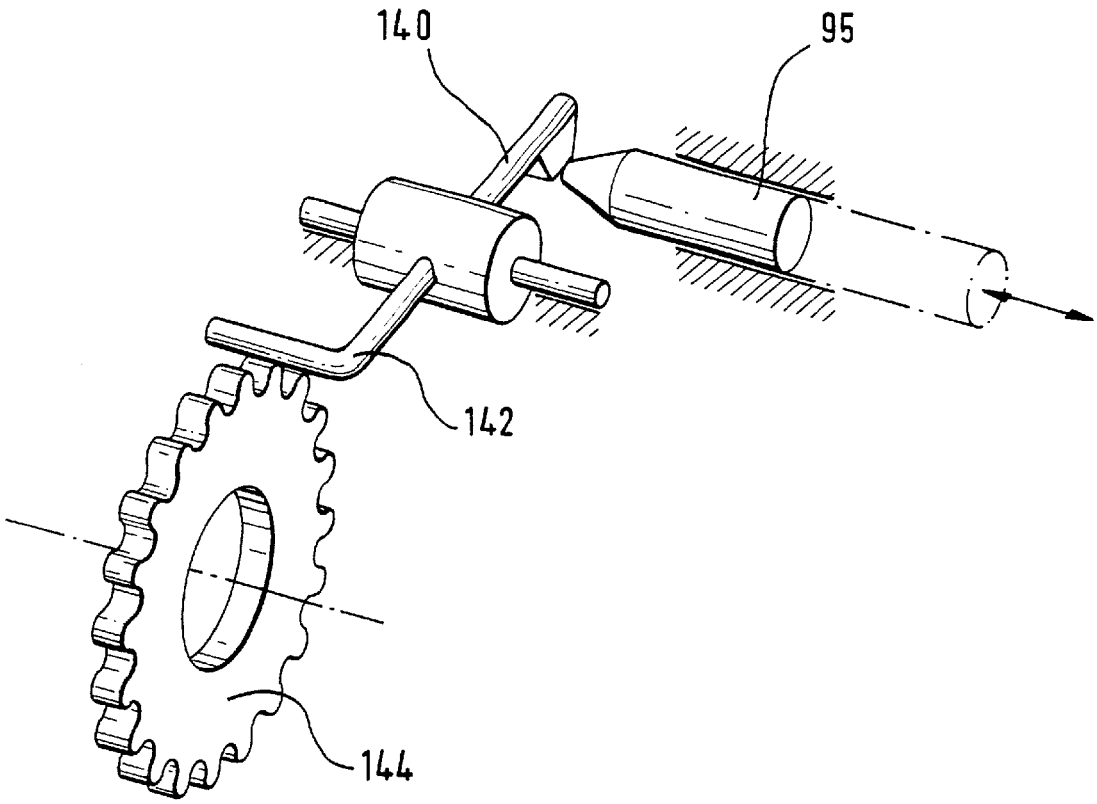
FIG. 13 is a pawl mechanism, as it can be actuated by the second and the third exemplary embodiment.

FIG. 13 illustrates how the axial forward motion of the rod 95 can be used to actuate the brake device 100. Due to the forward motion of the rod 95, a pawl 140 that is fixed in the housing and supported in bearings in a fashion that allows it to rotate freely is rotated. The pawl 140 then rotates, and a meshing part 142 is inserted into a toothed washer 144, so that a positive engagement is produced between meshing part 142 and washer 144. If this washer 144 is connected to the tang shaft 64 in frictionally engaged fashion as shown in the example according to FIG. 2, the driven element 70 is moved into mesh with the ring gear 77 of the internal combustion engine when the starter motor is rotated at the same time in combination with the meshing drive 65.

As shown, the stator 22 or the pole tube 25 or the rotor 23 or the rod or rods 95 must be displaced in at least one moving direction or from its position in order to actuate the brake device 100. The actuation can take place by means of displacement or rotation. Both moving directions thereby form a number of moving directions that include both moving directions.

The actuation of the brake device 100 according to the various exemplary embodiments is not limited to the actuation by a starter motor part 21, such as by the stator 22 or the rotor 23, for example. The actuation or rotation of the keyway element 104 and the rotation of the pawl 140 is possible by means of the electrical solenoid initially mentioned in the prior art, wherein a traction mechanism can also be located between the pawl 140 and the solenoid. A further possibility is given by the fact that the pawl 140 is actuated by means of a smaller electric motor opposite to the starter motor 20.

What is claimed is:

1. A starter device for starting internal combustion engines, comprising a starter motor (20) that comprises a stator (22) and a rotor (23) as starter motor components (21) and a drive shaft (58), further having a driven element (70) that can actively be connected to the drive shaft (58) and the internal combustion engine, and having a brake device (100) that acts on the driven element (70), wherein, by switching on the starter motor (20), the brake device (100) can be actuated by means of a change of position of a pole tube (25) of the stator (22), whereby a braking torque can act on the drive shaft, wherein said braking torque leads to a toeing-in of the driven element (70).

2. The starter device according to claim 1, wherein the brake device (100) can be actuated by a change in position of a starter motor component (21, 22, 23).

3. The starter device according to claim 2, wherein, by means of the change in position of a starter motor component (21,22,23), a ratchet (14) can be moved onto a disk (144) connected to the driven shaft (72), wherein, by means of positive engagement between ratchet (140) and disk (144), a braking torque can be produced on the rotating drive shaft (72).

4. The starter device according to claim 3, wherein the disk (144) is frictionally engaged with the drive shaft (72).

5. The starter device according to claim 3, wherein the ratchet (140) can be moved by means of a rod (95) moved by the displaced starter motor component (21, 22, 23).

6. The starter device according to claim 5, wherein the rod (95) can be moved in at least one moving direction.

7. The starter device according to claim 6, wherein the at least one moving direction is part of a number of moving directions that includes displacement and rotation.

8. The starter device according to claim 3, wherein the disk (144) touches a first axial stop on one side and, on the other, is supported on a second axial stop by means of a spring element (188).

9. The starter device according to claim 8, wherein a disengagement spring (76) is supported with a first end on a ring (186) between the first stop and the spring element (168).

10. The starter device according to claim 9, wherein the disengagement spring (76) is supported with a second end on the drive-end housing (17).

11. The starter device according to claim 1, wherein brake keys (108) can be pressed against a brake drum (106) by means of a keyway element (104) rotated by a starter motor component (21, 22, 23), by way of which a braking torque can be applied to the drive shaft (72).

12. The starter according to claim 1, wherein the brake device (100) can be actuated by change in position of the rotor (23).

13. The starter device according to claim 1, wherein the pole tube (25) is enclosed ins starter motor housing (16) and is supported in the starter motor housing (16) by means of a bearing element (128).

14. The starter device according to claim 13, wherein the rotor (23) is supported in the starter motor housing (16) by means of a rotor bearing (84).

15. The starter device according to claim 1, wherein a spring element (92) counteracts the change in position of the starter motor component (21, 22, 23).

* * * * *